US007640777B2

(12) United States Patent
Sakamoto

(10) Patent No.: US 7,640,777 B2
(45) Date of Patent: Jan. 5, 2010

(54) PUNCH PRESS WITH FORMING DIES AND OPERATION METHOD FOR THE SAME

(75) Inventor: Hiroichi Sakamoto, Inuyama (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 554 days.

(21) Appl. No.: 11/543,057

(22) Filed: Oct. 5, 2006

(65) Prior Publication Data

US 2007/0101798 A1 May 10, 2007

(30) Foreign Application Priority Data

Nov. 9, 2005 (JP) ..... 2005-324875

(51) Int. Cl.
*B21D 28/20* (2006.01)
*B21D 5/02* (2006.01)
*B21J 9/18* (2006.01)

(52) U.S. Cl. ..... 72/446; 72/442; 72/448; 72/452.8; 72/452.9; 83/552; 83/628; 83/76.7; 100/291

(58) Field of Classification Search ..... 72/184, 72/441, 442, 443, 452.8, 452.9, 456, 446, 72/448; 83/76.7, 98, 548, 552, 571, 623, 83/628; 100/291
See application file for complete search history.

(56) References Cited

U.S. PATENT DOCUMENTS 3,628,231 A * 12/1971 Pancook ..... 83/552
4,343,210 A * 8/1982 Kuroyone ..... 83/74
4,977,804 A * 12/1990 Naito ..... 83/76.7
5,092,151 A * 3/1992 Catti et al. ..... 72/443
6,021,658 A * 2/2000 Liinamaa et al. ..... 72/452.1
6,109,090 A * 8/2000 Perazzolo ..... 72/442
6,401,514 B1 * 6/2002 Virtanen et al. ..... 72/452.9
6,526,800 B1 * 3/2003 Virtanen et al. ..... 72/452.9

FOREIGN PATENT DOCUMENTS

JP 62-220225 * 9/1987
JP 2889951 A 2/1999
JP 2004-216416 A 8/2004

* cited by examiner

*Primary Examiner*—David B Jones
(74) *Attorney, Agent, or Firm*—Westerman, Hattori, Daniels & Adrian, LLP

(57) ABSTRACT

The present invention provides a punch press with forming dies which reduces the limitation on the number and positions of forming dies attached to the die supporting member, the punch press enabling a device that elevates and lowers forming dies to operate appropriately without being affected by slag. The punch press with forming dies includes a die supporting member 2 that supports a plurality of forming dies 5 so that the forming dies 5 can be elevated and lowered, a die elevating and lowering driving device 16 that elevates and lowers the forming dies 5, and a die supporting member moving device that moves the die supporting member 2 so as to locate one of the forming dies 5 at a punch position P. The die elevating and lowering driving device 16 includes an elevating and lowering device 30 having an elevating and lowering member 35 that elevates and lowers the forming die 5 located at the punch position P and an elevating and lowering driving member 39 that drivingly elevates and lowers the elevating and lowering member 35, and further includes position switching means 31 for switching the elevating and lowering device 30 between a position B below the die supporting member 2 and a retracting position A outside the die supporting member 2.

3 Claims, 10 Drawing Sheets

PUNCH PRESS WITH FORMING DIES AND OPERATION METHOD FOR THE SAME

FIELD OF THE INVENTION

The present invention relates to a punch press with forming dies supported on a die supporting member such as a turret, to elevate and lower any of the forming dies for punching, and the present invention also relates to an operation method for a punch press with forming dies.

BACKGROUND OF THE INVENTION

FIG. 12 is a diagram showing the general configuration of a turret type punch press. The turret type punch press has an upper turret 1 that circumferentially supports a plurality of punch tools and a lower turret 2 that circumferentially supports a plurality of die tools 5. The upper turret 1 and the lower turret 2 are rotated to locate a desired set of the punch tool 4 and die tool 5 at a predetermined punch position P to punch a workpiece W that is a plate material.

Punching includes piercing and forming. Piercing involves fixing the die tool 5 so that its top surface is flush with a top surface of a workpiece table 18, and under this condition, lowering the punch tool 4 for piercing. Carrying out forming in a similar manner forms a formed part of the workpiece W below the top surface of the workpiece table 18. In this case, the formed part may interfere with the workpiece table 18 to hinder workpiece feeding. Thus, for forming, for example, upward forming, an upward protruding die tool for forming (hereinafter referred to as a "forming die") 5 is used to form the workpiece W so that its formed part is formed above the top surface of the workpiece table 18.

Examples of such forming include a method of fixing the forming die 5 at a given position where the top surface of the forming die 5 is above the top surface 18*a* of the workpiece table 18 and lowering the punch tool 4 as shown in FIG. 13 and a method of fixing the punch tool 4 at a given position where a bottom surface of the punch tool 4 is at the same height as that of the top surface 18*a* of the workpiece table 18 and elevating the forming die 5 as shown in FIG. 14. FIG. 13A and FIG. 14A show conditions before forming, and FIG. 13B and FIG. 14B show conditions during forming. Where the punch tool 4 is lowered for forming as shown in the example in FIG. 13, the forming dies 5 located away from the punch position P are retracted to a lowering position below the top surface 18*a* of the workpiece table 18 in order to prevent hindrance to feeding of the workpiece W and damage to the back surface of the workpiece W. Thus, with either method for forming, the forming die 5 located at the punch position P needs to be elevated and lowered. The punch press is accordingly provided with an appropriate elevating and lowering device (for example, Japanese Patent No. 2889951).

The elevating and lowering device is composed of an advancing and retreating member formed as an inclined surface portion having a top surface inclined in one direction, and an actuator that advances and retreats the advancing and retreating member in the direction in which the inclined surface portion is inclined. With the inclined surface portion abutting against a part of the forming die located at the punch position, the advancing and retreating member is advanced or retreated to elevate or lower the forming die. According to Japanese Patent No. 2889951, the inclined surface portion of the advancing and retreating member is inclined in a direction orthogonal to a virtual straight line joining the punch position to the rotating center of the turret, that is, in a tangential direction of a circular trajectory along which the die tool is moved, and the advancing and retreating member also advances and retreats in this direction.

In the punch press according to Japanese Patent No. 2889951, the elevating and lowering device for the forming dies is fixed at the punch position. Further, the advancing and retreating member advances and retreats in the tangential direction to elevate and lower the forming dies. Accordingly, even while the forming dies are lowering, the advancing and retreating member is located immediately below the circular trajectory or its vicinity. Thus, where a plurality of forming dies are provided in the lower turret in proximity to one another, when one of the forming dies is located at the punch position, the advancing and retreating member may interfere with forming dies located close to the punch position. Increasing the advancing and retreating strokes of the advancing and retreating member can avoid this interference. However, this disadvantageously increases the size of the elevating and lowering device, and the time required for the forming dies to elevate and lower. As a result, where a plurality of forming dies are provided in the lower turret, they are forced to be spaced at intervals. This limits the number and positions of forming dies attached. Further, since the advancing and lowering member is always located below the turret, slag falling from the turret adheres to the advancing and retreating member, and its advancement and retreat guiding section. This may hinder the operation of the elevating and lowering device.

When the advancing and retreating member advances and retreats in the tangential direction as is the case with the conventional punch press, one elevating and lowering device can elevate and lower only the forming dies on one circumference. Thus, where the forming dies are provided on a plurality of concentric circles, as many elevating and lowering devices as the concentric circles must be provided. This complicates the structure of peripheral portion of the punch position.

An object of the present invention is to provide a punch press with forming dies which reduces the limitation on the number and positions of forming dies attached to the die supporting member and which enables a device that elevates and lowers the forming dies to operate appropriately without being affected by slag. Another object of the present invention is to reduce the moving distance of the device that elevates and lowers the forming dies and to facilitate the movement. Further another object of the present invention is to, where the forming dies are provided on each of plural concentric circles, enable a single device to elevate and lower the forming dies on each concentric circle. Further another object of the present invention is to facilitate the position switching of an elevating and lowering member, while supporting a die supporting member so that the die supporting member is movable in a horizontal direction.

SUMMARY OF THE INVENTION

A punch press with forming dies according to the present invention comprises a die supporting member that supports a plurality of forming dies so that the forming dies can be elevated and lowered, a die elevating and lowering driving device that elevates and lowers the forming dies, and a die supporting member moving device that moves the die supporting member so as to locate one of the forming dies at a punch position. The die elevating and lowering driving device comprises an elevating and lowering device including an elevating and lowering member that elevates and lowers the forming die located at the punch position and an elevating and lowering driving member that drivingly elevates and lowers the elevating and lowering member, and further comprises position switching means for switching the elevating and lowering device between a position below the die supporting member and a retracting position outside the die supporting member.

In this configuration, the die supporting member moving device moves the die supporting member to locate one of the forming dies supported on the die supporting member, at the punch position. The forming die located at the punch position is elevated and lowered by the die elevating and lowering driving device. With the elevating and lowering device moved to below the die supporting member by the position switching member, the die elevating and lowering driving device operates to cause the elevating and lowering driving member of the elevating and lowering device to drivingly elevate and lower the elevating and lowering member to raise and lower the forming die. When no forming dies need to be elevated or lowered, the position switching means retreats the elevating and lowering device to the retracting position outside the die supporting member. Since the elevating and lowering device is located at the retracting position outside the die supporting member when no forming dies need to be elevated or lowered, the elevating and lowering device is prevented from interfering with forming dies located close to the forming die fixed at the punch position. This avoids limiting the number and positions of forming dies attached to the die supporting member, and a plurality of forming dies can be freely arranged on the die supporting member depending on operation type or procedure. Further, the elevating and lowering device is retracted to outside the die supporting member except when any forming die is elevated for punching. This prevents slag from adhering to the elevating and lowering device, which can thus always operate appropriately.

According to the present invention, the die supporting member is a circular or fan-shaped turret that moves rotatably to bring the forming die to the punch position. In this case, the position switching means preferably moves the elevating and lowering device in a direction of a virtual straight line joining the punch position to a rotating center of the turret. When the position of the elevating and lowering device is switched by moving the elevating and lowering device in the direction of the virtual line joining the punch position to the rotating center of the turret, the moving distance of the elevating and lowering device can be minimized to reduce the size of the die elevating and lowering driving device.

The turret has the forming dies provided on a plurality of concentric circles around the rotating center of the turret. Since the elevating and lowering device moves in the direction of the virtual line joining the punch position to the rotating center of the turret, even if forming dies are provided on each of plural concentric circles, the forming dies on each concentric circle can be elevated and lowered by one elevating and lowering device.

The die supporting member is supported by a bolster from below and be movable in a horizontal direction. In this case, an opening is formed in the bolster so that the elevating and lowering device can enter the opening. When the die supporting member is supported by the bolster from below, the die supporting member is prevented from being distorted during machining. When the opening is formed in the bolster so that the elevating and lowering device can enter the opening, the position of the elevating and lowering device can be switched through the opening. This facilitates the position switching of the elevating and lowering device.

The punch press with forming dies according to the present invention comprises the die supporting member that supports the plurality of forming dies so that the forming dies can be elevated and lowered, the die elevating and lowering driving device that elevates and lowers the forming dies, and a die supporting member moving device that moves the die supporting member so as to locate one of the forming dies at a punch position. The die elevating and lowering driving device comprises the elevating and lowering member that elevates and lowers the forming die located at the punch position, and the elevating and lowering device composed the elevating and lowering driving member that drivingly elevates and lowers the elevating and lowering member, and further comprises the position switching means for switching the elevating and lowering device between the position below the die supporting member and the retracting position outside the die supporting member. This reduces the limitation on the number and positions of forming dies attached to the die supporting member. The device that elevates and lowers the forming dies can operate appropriately without being affected by slag.

Where the die supporting member is a circular or fan-shaped turret that moves rotatably to bring the forming die to the punch position, and the position switching means preferably moves the elevating and lowering device in the direction of the virtual straight line joining the position below the die supporting member to the rotating center of the turret, the moving distance of the elevating and lowering device can be minimized to reduce the size of the die elevating and lowering driving device.

Where the turret has the forming dies provided on the plurality of concentric circles around the rotating center of the turret, the forming dies on each concentric circle can be elevated and lowered by one elevating and lowering device.

Where the die supporting means is supported by the bolster from below and be movable in the horizontal direction, and the opening is formed in the bolster so that the elevating and lowering device can enter the opening, the die supporting member is prevented from being distorted during machining. This also facilitates the position switching of the elevating and lowering device.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 2 is a diagram showing a forming method using forming dies and employed for the punch press.

FIG. 3 is a diagram showing another forming method using forming dies and employed for the punch press.

FIG. 8 is a sectional view of essential part of an elevating and lowering device.

FIG. 13 is a diagram showing a forming method.

FIG. 14 is a diagram showing a forming method.

DETAILED DESCRIPTION OF THE PREFERRED EMBODIMENTS

Figure 1:
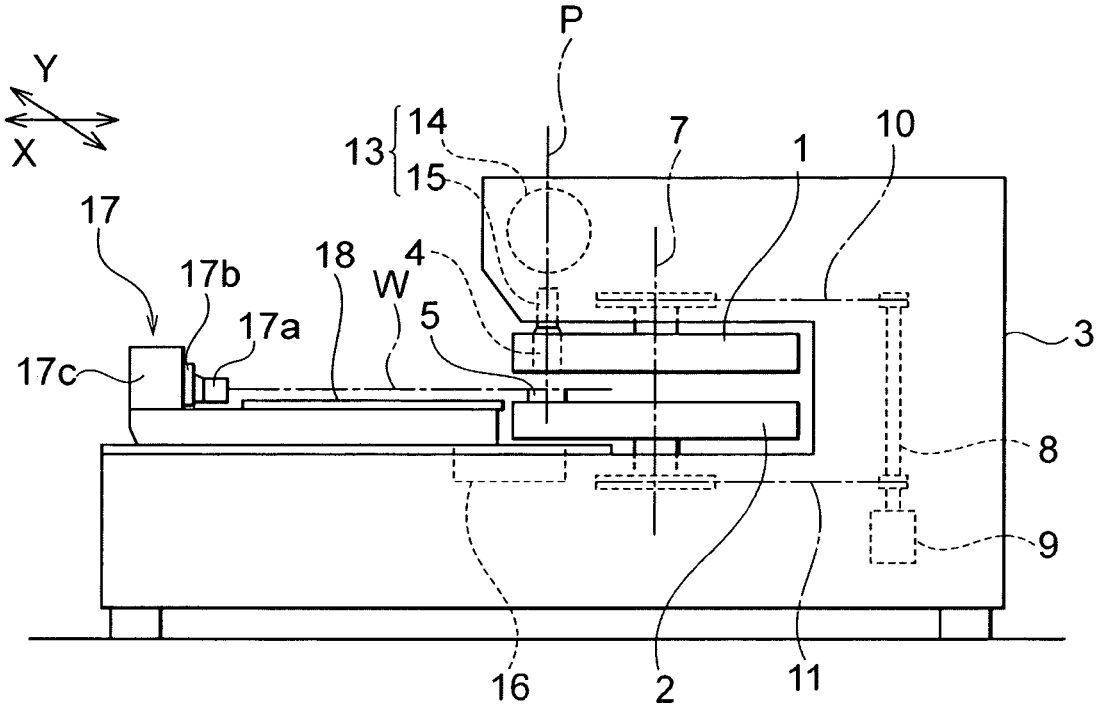
FIG. 1 is a side view of a punch press according to an embodiment of the present invention.

An embodiment of the present invention will be described with reference to the drawings. This embodiment is obtained by applying the present invention to a turret type punch press shown in FIG. 1. The punch press has an upper turret 1 and a lower turret 2 concentrically arranged in a frame 3; the upper turret 1 is a support member for punch tools and the lower turret 2 is a support member for die tools. An indexing station of the upper turret 1 is provided with various punch tools 4, and an indexing station of the lower turret 2 is provided with various die tools 5.

Each of the upper turret 1 and lower turret 2 has a circular planar shape and is rotatable around a rotating center axis 7. A turret moving device 8 rotatably moves the upper turret 1 and lower turret 2 to bring any of the punch tools 4 and any of the die tools 5 at a predetermined position P located on circumferences on which the indexing stations are arranged. The turret moving device 8 uses a common motor 9 for the upper turret 1 and lower turret 2 to transmit rotation to the upper turret 1 and lower turret 2 via chain mechanisms 10, 11. The upper turret 1 and lower turret 2 may have a fan-shaped planar shape. The punch tools 4 and die tools 5 may be supported by a support member different from the turret. In this case, the turret moving device 8 is a punch die supporting member moving device.

Figure 2A:
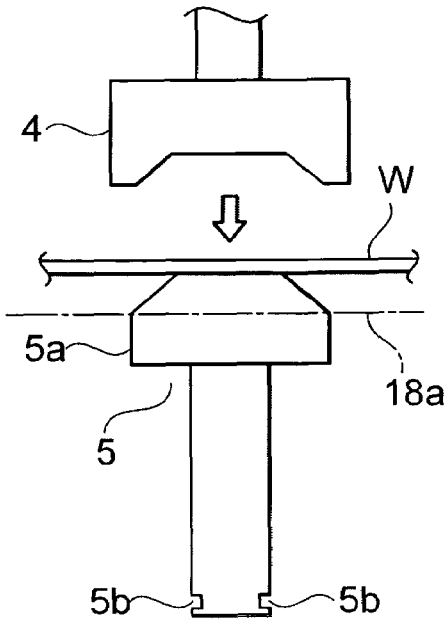
FIG. 2A shows the condition of a punch tool and a forming die immediately before punching.
Figure 2B:
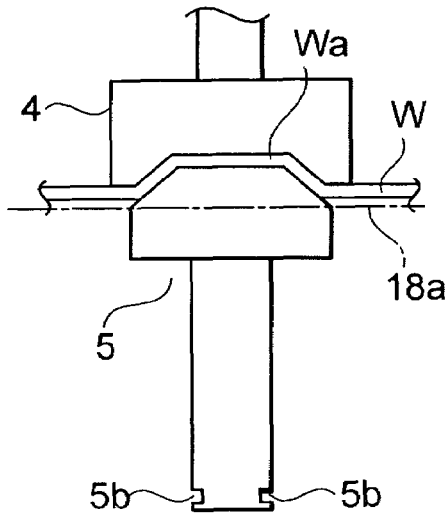
FIG. 2B shows the condition of the punch tool and forming die during punching.
Figure 3A:
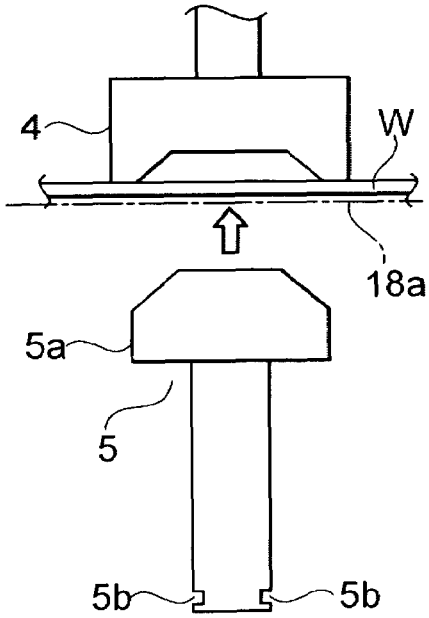
FIG. 3A shows the condition of the punch tool and forming die immediately before punching.
Figure 3B:
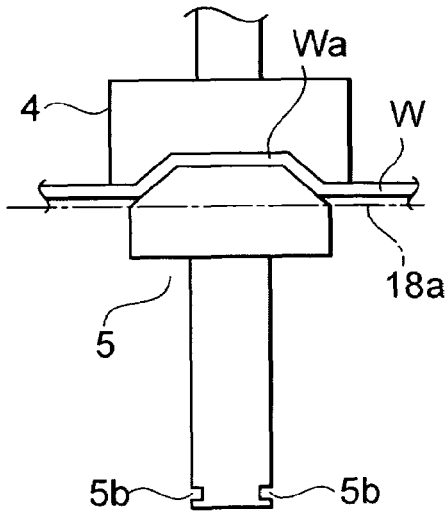
FIG. 3B shows the condition of the punch tool and forming die during punching.

Each of the punch tools 4, provided on the upper turret 1, is drivingly elevated and lowered at the punch position P by punch driving means 13. The punch driving means 13 comprises a crank mechanism 14 and a ram 15 that is elevated and lowered by the crank mechanism 14. The punch driving means 13 elevates and lowers the punch tool 4 via the ram 15. Some of the die tools 5, provided on the turret 2, are forming dies 5 that can be elevated and lowered at the punch position by a die elevating and lowering driving device 16, described later. As shown in FIGS. 2 and 3, for upward forming, each of the forming dies 5 has an upward protruding forming portion 5*a* that is combined with the recessed punch tool 4.

A workpiece W that is a plate material is fed by a workpiece feeding mechanism 17 in a fore-to-aft direction and a lateral direction on a workpiece table 18 so that its desired area is located at the punch position P. The workpiece feeding mechanism 17 feeds the workpiece W the end of which is gripped by a workpiece holder 17*a*. A workpiece holder 17*a* is attached to a cross slide 17*b* installed on a carriage 17*c* so as to be movable in a lateral (X) direction; the carriage 17*c* is movable on the frame 3 in a fore-to-aft (Y) direction. The workpiece table 18 is a planar table provided with sliding means such as a free bearing on which the workpiece W is placed for guidance.

Figure 4A:
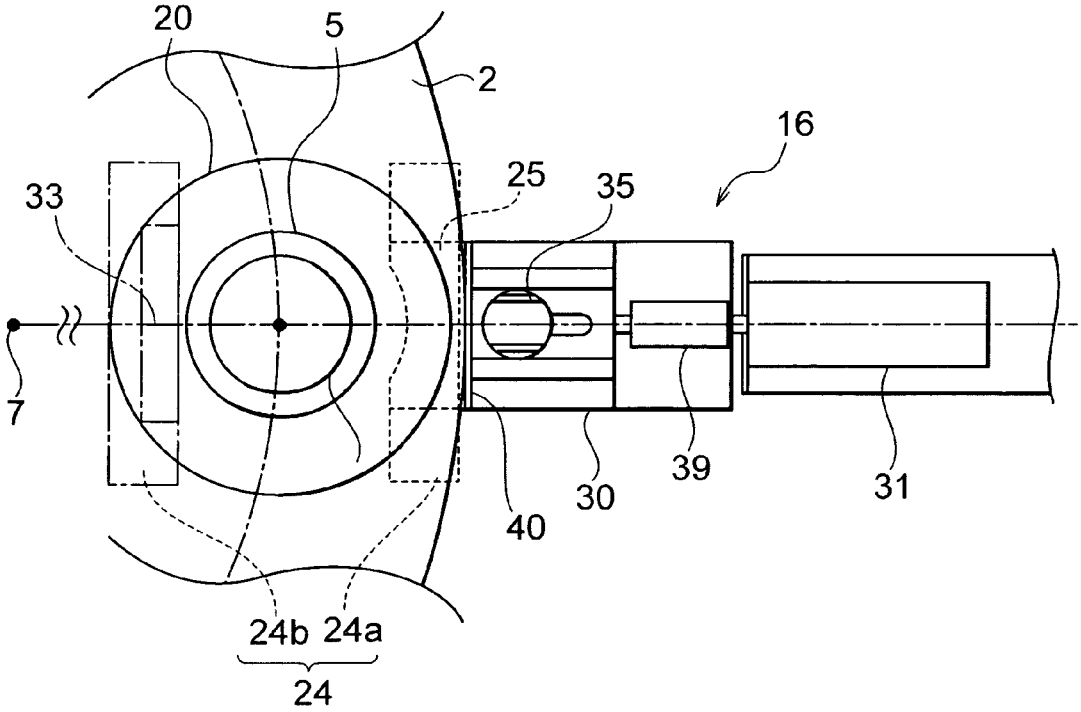
FIG. 4A is a plan view of a peripheral portion of a forming die attaching position.
Figure 4B:
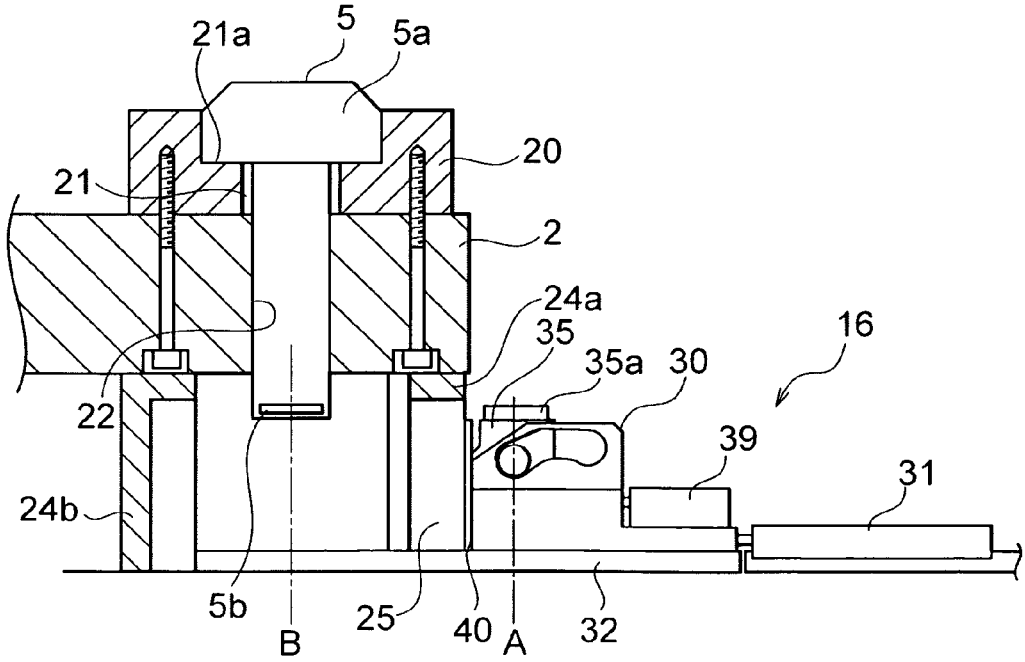
FIG. 4B is an exploded side view of the peripheral portion of the forming die attaching position.
Figure 5:
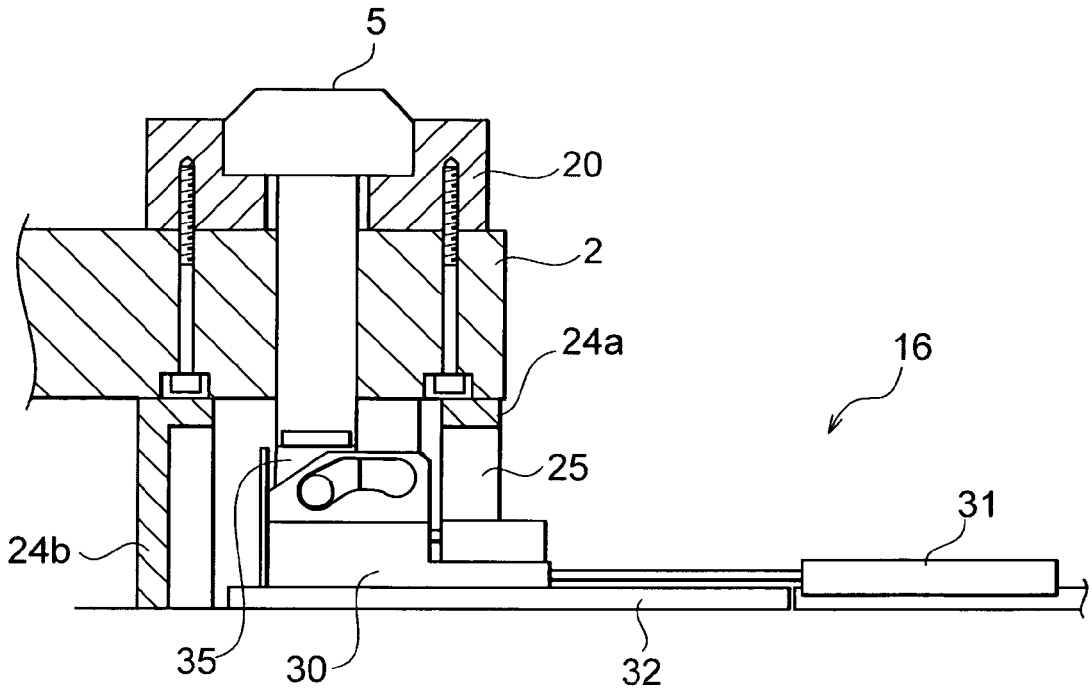
FIG. 5 is an exploded side view showing a different condition of the peripheral portion of the forming die attaching position.
Figure 6:
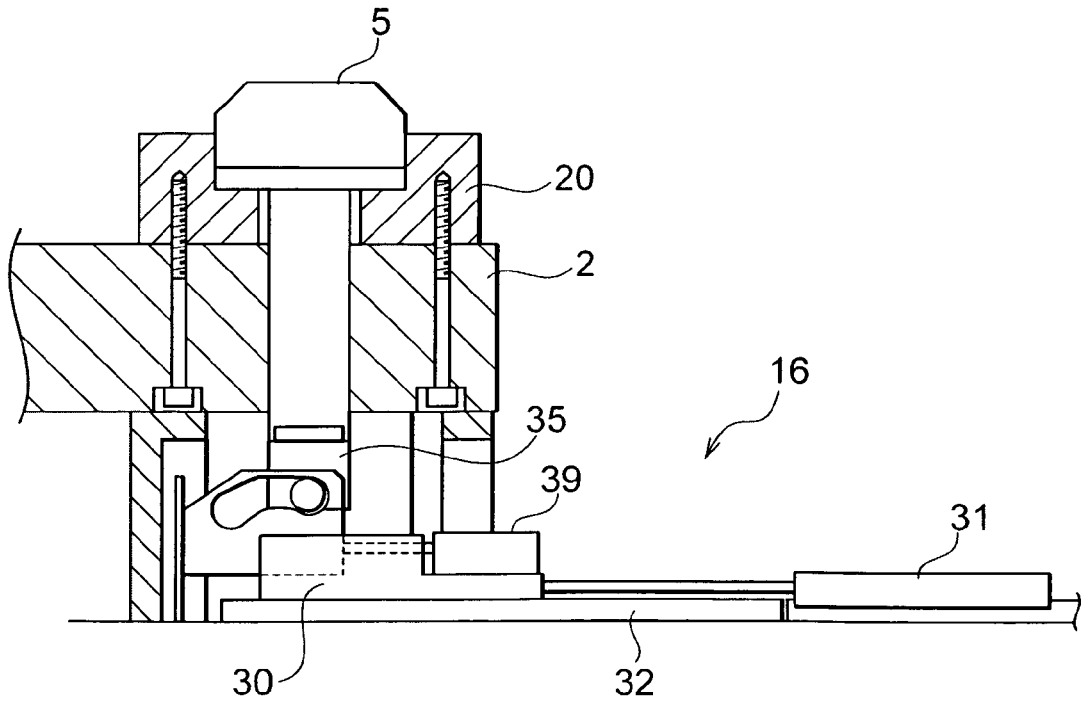
FIG. 6 is an exploded side view showing a further different condition of the peripheral portion of the forming die attaching position.

As shown in FIGS. 4 to 6, each of the forming dies 5 is attached to the lower turret 2, a die supporting member, via a die holding stand 20. The die holding stand 20 has a counter sunk die attaching hole 21 formed in its central portion and which penetrates the die holding stand 20 in a vertical direction. The planar position of the die attaching hole 21 is aligned with a die inserting hole 22 formed in the lower turret 2 to fix the die holding stand 20 to a top surface of the lower turret 2 by bolts or the like. The forming die 5 is fitted and held in the die attaching hole 21 and die inserting hole 22 so as to be slidable in the vertical direction. In the example shown in FIGS. 4 to 6, the forming die 5 is slidable through the die inserting hole 22. However, the forming die 5 is slidable through the die attaching hole 21. As shown in FIGS. 4B and 5, a forming portion 5*a* with a larger diameter normally engages with a counter sunk surface 21*a* of the die attaching hole 21. In this condition, a lower end of the forming die 5 projects downward from the die inserting hole 22. An engaging groove 5*b* shaped as shown in FIGS. 2 and 3 is formed in a side surface of a projecting lower end of the forming die 5, in a radial direction of the lower turret 2.

A bolster 24 is provided in the vicinity of the punch position P and below the lower turret 2 to support the lower turret 2 from below so as to prevent the lower turret 2 from being distorted during punching. The bolster 24 receives a punch load and does not hamper the discharge of slag that may be generated during punching. In this example, the bolster 24 is composed of a pair of bolster members 24*a*, 24*b* arranged away from each other across the punch position P in the radial direction of the lower turret 2. The radially outer bolster member 24*a* is shaped like a gate and has an opening 25 through which an elevating and lowering device 30 described below moves into and out of the bolster 24. The paired bolster members 24*a*, 24*b* is provided at positions such that the projecting lower end of the forming die 5 does not interfere with the bolster members 24*a*, 24*b* during rotation of the lower turret 2.

Figure 7:
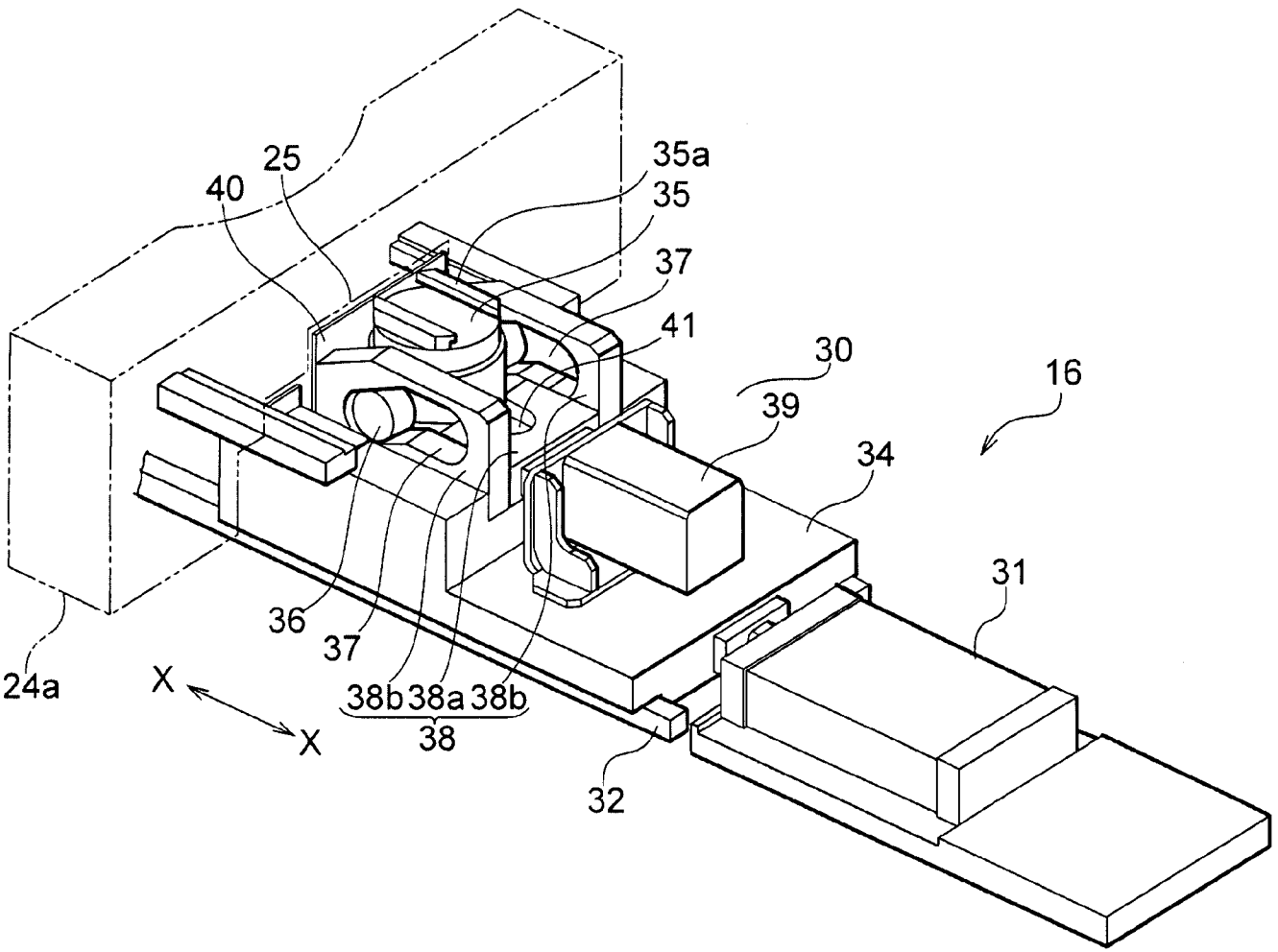
FIG. 7 is a perspective view of a die elevating and lowering driving device.

Now, the die elevating and lowering driving device 16 will be described with reference to FIGS. 7 to 9. The die elevating and lowering driving device 16 comprises the elevating and lowering device 30 that is switched by position switching means 31 between a position below the lower turret 2 and a retracting position away from the lower turret 2. In the present embodiment, the position switching means 31 is a cylinder that moves the elevating and lowering device 30 along a rail 32 laid on the frame 3 in the direction (X direction) of a virtual straight line 33 (shown in FIG. 4) joining the punch position P to the rotating center 7 of the lower turret 2. During this movement, the position of the elevating and lowering device 30 is switched by moving it through the opening 25 of the radially outer bolster member 24*a*.

The elevating and lowering device 30 is composed of a base member 34 that is movable on the rail 32, an elevating and lowering member 35 supported on the base member 34 so as to freely elevate and lower and having a engaging protrusion 35*a* with a hook-shaped cross section which can engage with the engaging groove 5*b* of the forming die 5, a pair of cam rollers 36 rotatably attached to the opposite side surfaces of the elevating and lowering member 35, a cam member 38 that is slidable in the X direction with respect to the base member 34, the cam member 38 having a cam groove 37 that engages with the cam roller 36, a cylinder type elevating and lowering driving member 39 that moves the cam member 38 in the X direction, and a cover 40 which is attached to an end surface of the cam member 38 which is closer to the turret rotating center and which can pass through the opening 25, the cover 40 being almost as large as the opening 25.

Figure 8A:
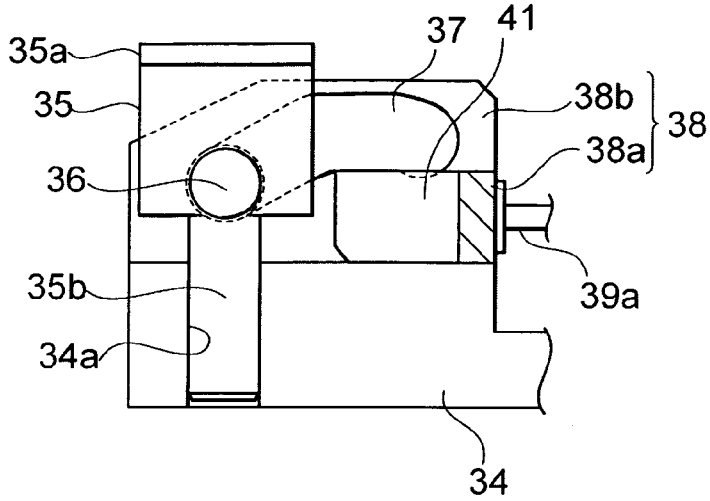
FIGS. 8A, 8B, and 8C show different conditions.
Figure 8B:
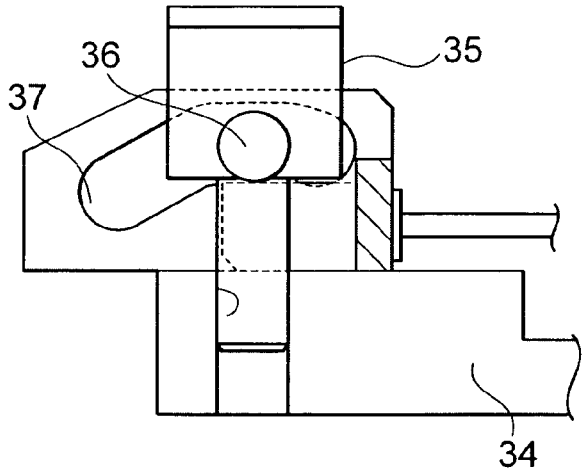
Figure 8C:
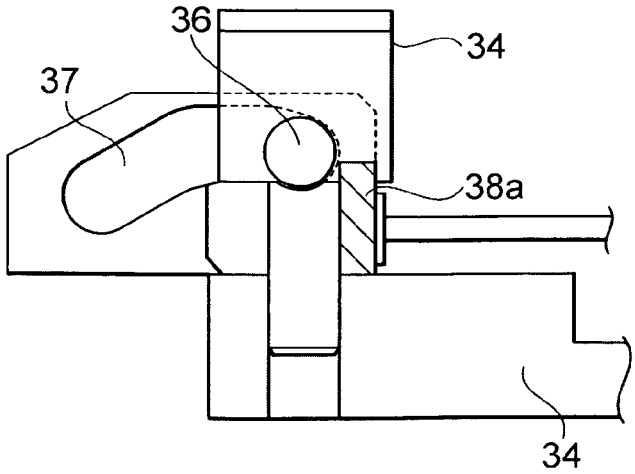

As shown in FIG. 8, a vertical shaft portion 35*b* is provided in the lower part of the elevating and lowering member 35. The shaft portion 35*b* is slidably fitted into an elevating and lowering member attaching hole 34*a* formed in the base member 34, to support the elevating and lowering member 35 to freely elevate from and lower toward the base member 34. The cam member 38 is composed of a horizontally wide middle portion 38*a* and vertically tall opposite side portions 38*b*. A piston rod 39*a* of the cylinder constituting the elevating and lowering driving member 39 is coupled to a rear surface of the middle portion 38*a*, and the cam grooves 37 are formed in the respective side portions 38*b*. A top surface of the cam member middle portion 38*a* is formed level so as to constitute a surface on which the elevating and lowering member 35 is seated during pressing. A recessed portion 41 is formed in the cam member middle portion 38*a* so that when the cam member 38 advances toward the turret switching center, the shaft portion 35*b* of the elevating and lowering member 35 is fitted into the recessed portion 41.

Figure 9:
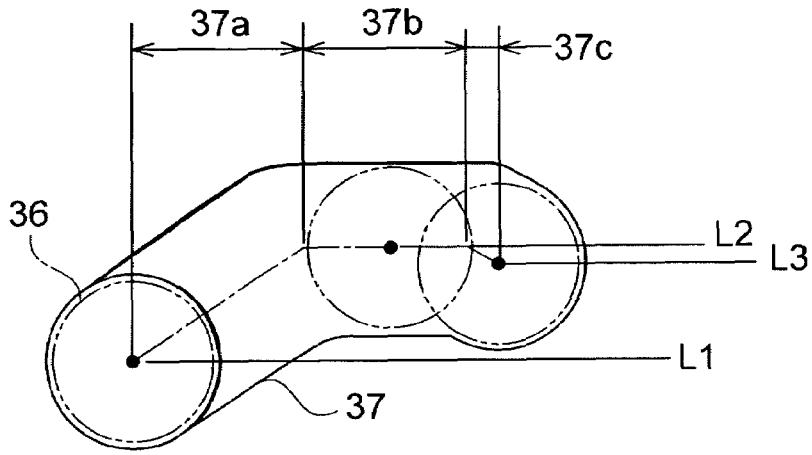
FIG. 9 is a diagram showing the shape of a cam groove.

As shown in FIG. 9, the cam groove 37 is composed of an inclined portion 37*a* that becomes gradually lower as the inclined portion 37*a* approaches the turret rotating center side, a horizontal portion 37*b* connected to that side of the inclined portion 37*a* which is opposite the turret rotating center, and a step portion 37*c* further connected to that side of the horizontal portion 37*b* which is opposite the turret rotating center side, the step portion 37*c* being lower than the horizontal portion 37*b*. Advancing or retreating the cam member 38 in the X direction rolls the cam roller 36 along the cam groove 37 to change the height of the elevating and lowering member 35. Locating the cam roller 36 in the lowermost area of the inclined portion 37*a* sets the elevating and lowering member 35 at the lowest level L2. Locating the cam roller 36 in the horizontal portion 37*b* sets the elevating and lowering member 35 at the highest level L1. Locating the cam roller 36 in the step portion 37*c* sets the elevating and lowering member 35 at a machining level L3 that is slightly lower than the highest level L2.

The operation of the die elevating and lowering driving device 16 will be described. In an initial condition, as shown in FIG. 4, the elevating and lowering device 30 is located at a retracting position A outside the lower turret 2. To carry out forming with the forming die 5, the position switching means 31 is driven to move the elevating and lowering device 30 to the position B below the lower turret 2 as shown in FIG. 5. At the position B below the lower turret 2, the engaging protrusion 35*a* of the elevating and lowering member 35 engages with the engaging groove 5*b* of the forming die 5. The forming die 5, and the elevating and lowering member 35 are thus integrated together for vertical movement. At this time, the elevating and lowering member 35 is at the lowest level L1, where the cam roller 36 is located in the lowermost area of the inclined portion 37*a* of the cam groove 37.

Under these conditions, the elevating and lowering driving member 39 is driven to advance the cam member 38 to roll the cam roller 36 to the step portion 37*c* along the inclined portion 37*a* of the cam groove 37, and then, as shown in FIG. 6, the elevating and lowering member 35 rises up to the machining level L3. Thus, the forming die 5 is lifted to locate the top surface of the forming die 5 above the top surface 18*a* of the workpiece table 18. When the elevating and lowering member 35 is at the machining level L3, the elevating and lowering member 35 is supported by the middle portion 38*a* of the cam member 38 from below. To advance the cam member 38, the elevating and lowering member 35 once rises up to the highest level L2 and then lowers down to the slightly lower machining level L3. This allows the elevating and lowering member 35 to be smoothly seated on the middle portion 38*a* of the cam member 38.

With the forming die 5 thus elevated to lift the workpiece W above the top surface 18*a* of the workpiece table 18, the punch tool 4 is lowered for forming (see FIG. 2). On this occasion, the elevating and lowering member 35 is supported by the middle portion 38*a* of the cam member 38 from below and can withstand even a heavy forming load. This also avoids imposing a heavy load on the cam roller 36.

After pressing, the above operations are reversed to lower the elevating and lowering member 35 down to the lowest level L1. The elevating and lowering device 30 is further retreated to the retracting position A. To carry out piercing, the elevating and lowering device 30 is retreated to the retracting position A, and then, a suction device (not shown in the drawings) is used to suck and remove slag resulting from the piercing, from below the punch position P. Since the opening 25 is occluded by the cover 40 of the elevating and lowering device 30, the area below the punch position P is so closed that slag can be efficiently sucked.

With the die elevating and lowering driving device 16, when no forming dies 5 need to be elevated or lowered, the elevating and lowering device 30 is located at the retracting position A outside the lower turret 2 which is a die supporting member. Consequently, even if forming dies are arranged on adjacent indexing stations, the elevating and lowering device 30 is prevented from interfering with the forming dies 5 on the indexing station adjacent to the punch position P. This reduces the limitation on the number and positions of forming dies 5 attached to the lower turret 2, and a plurality of forming dies 5 can thus be freely arranged on the lower turret 2 depending on operation type or procedure. Further, the elevating and lowering device 30 is retracted to outside the lower turret 2 except when the forming dies 5 are elevated for punching. This prevents slag from adhering to the elevating and lowering device 30, which can thus always operate appropriately.

The position of the elevating and lowering device 30 is switched by moving the elevating and lowering device 30 in the direction (X direction) of the virtual straight line 33 joining the punch position P to the turret rotating center 7. During the position switching, the elevating and lowering device 30 can pass through the opening 25, formed in the bolster member 24*a*. This facilitates the position switching of the elevating and lowering device 30. As a result, the die elevating and lowering driving device 16 can be miniaturized and simplified.

Figure 10:
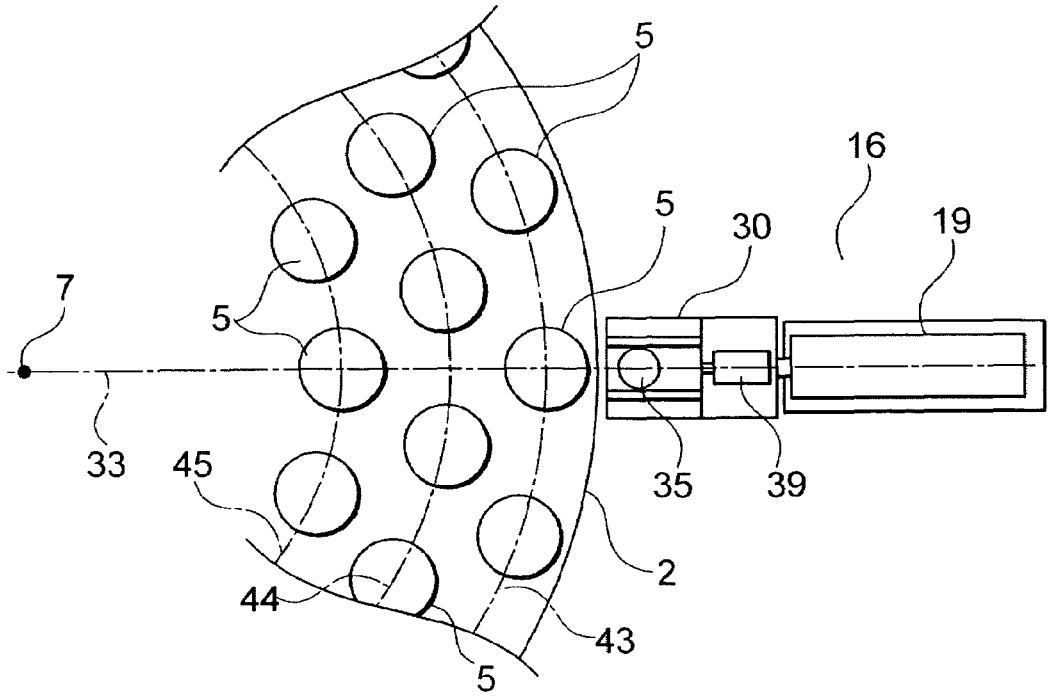
FIG. 10 is a plan view of a peripheral portion of a forming die attaching position in a different punch press.

When the elevating and lowering device 30 moves in the direction of the virtual straight line 33 joining the punch position P to the turret rotating center 7, even if the lower turret 2 has the forming dies 5 on each of plural concentric circles 43, 44, 45 as shown in FIG. 10, the forming dies 5 on each of the concentric circles 43, 44, 45 can be elevated and lowered by one elevating and lowering device 30.

Figure 11:
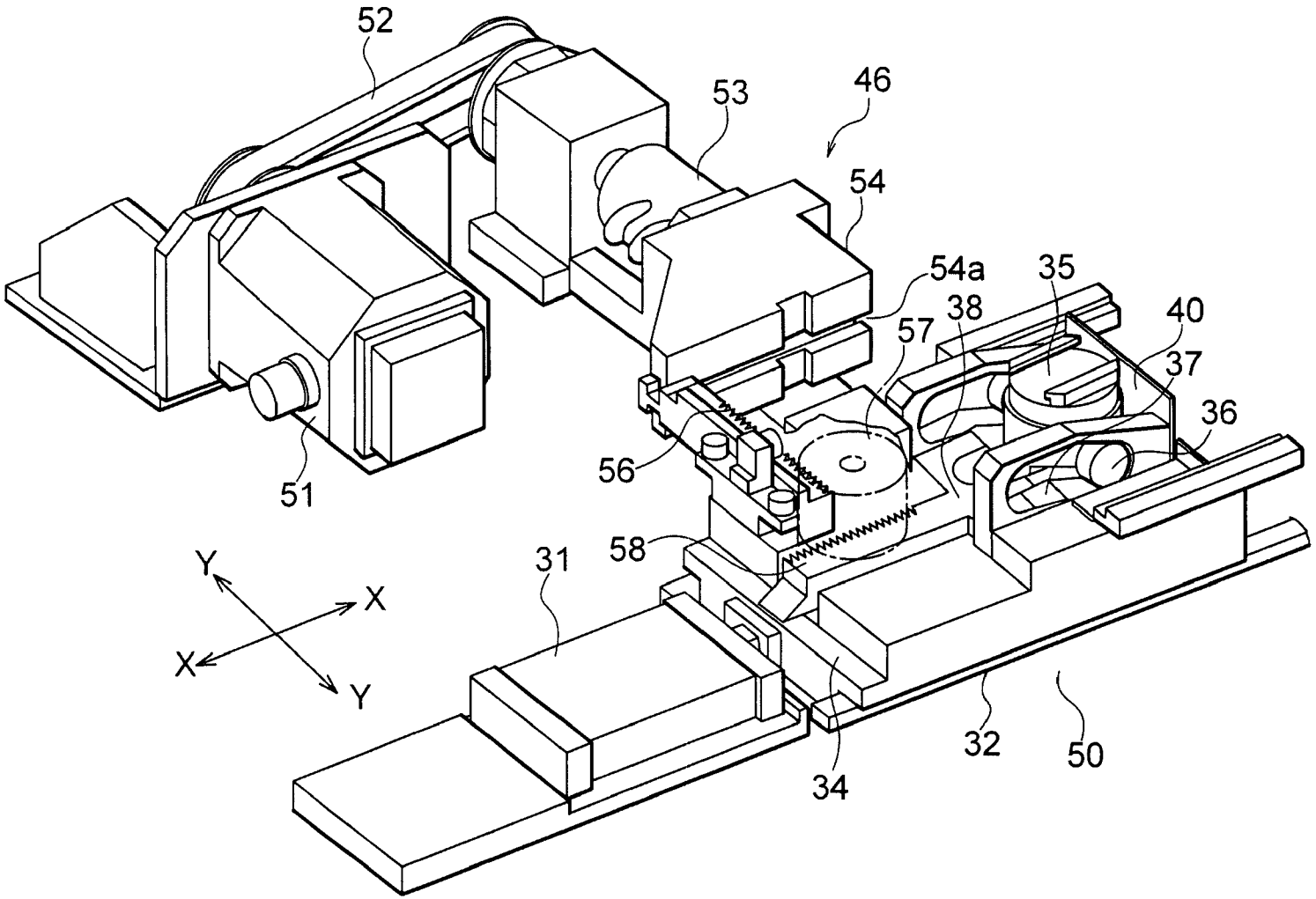
FIG. 11 is a perspective view of a different die elevating and lowering driving device.
Figure 12:
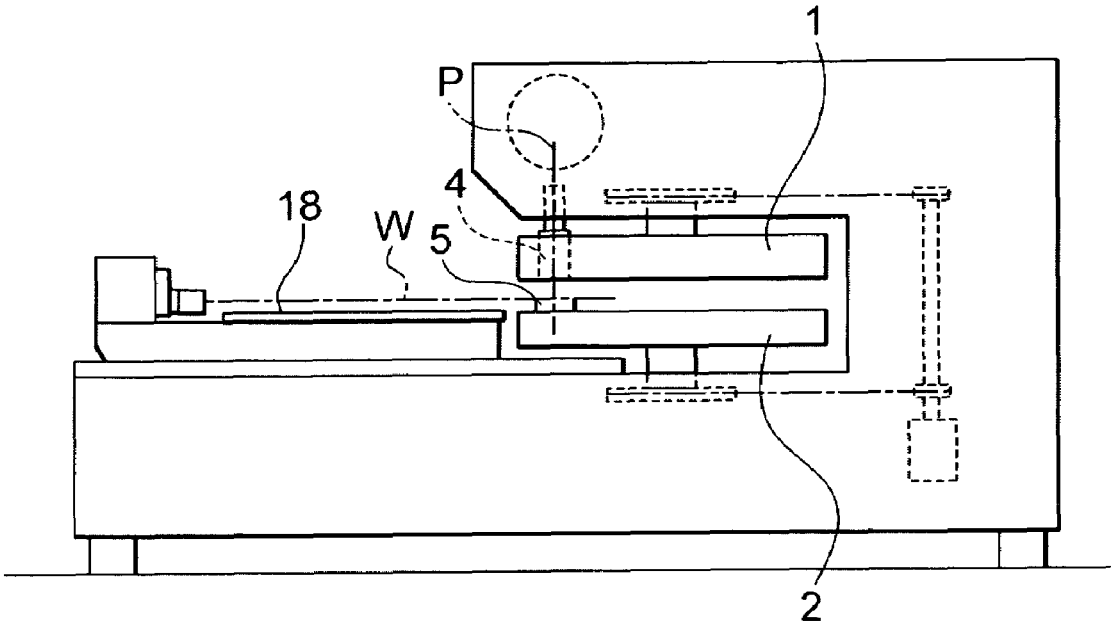
FIG. 12 is a side view of a conventional punch press.
Figure 13A:
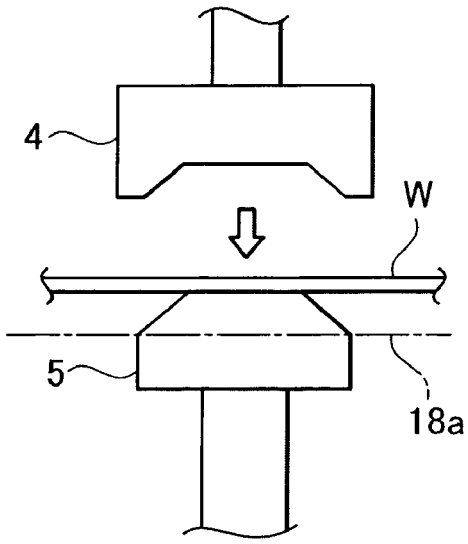
FIG. 13A shows the condition of a punch tool and a forming die immediately before punching.
Figure 13B:
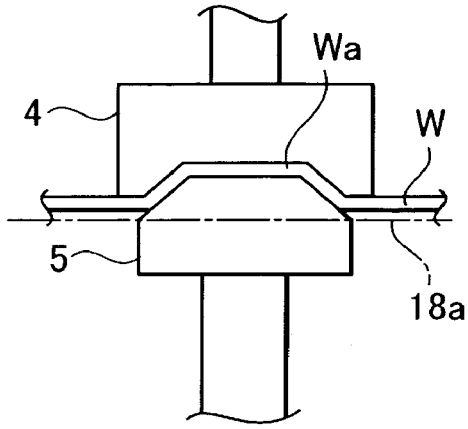
FIG. 13B shows the condition of the punch tool and forming die during punching.
Figure 14A:
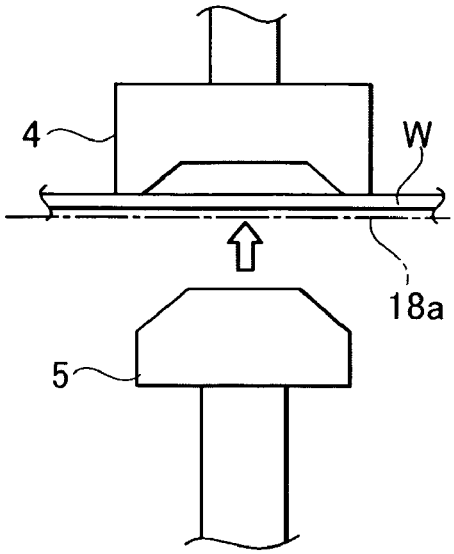
FIG. 14A shows the condition of the punch tool and forming die immediately before punching.
Figure 14B:
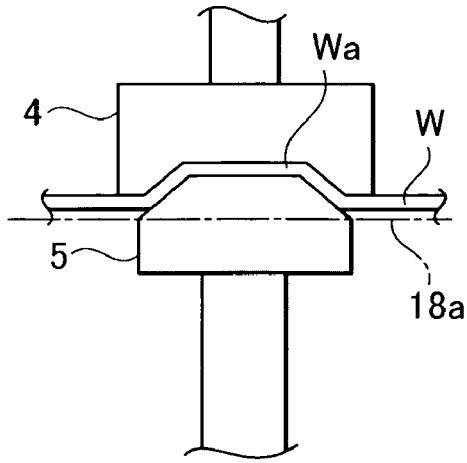
FIG. 14B shows the condition of the punch tool and forming die during punching.

FIG. 11 shows a different die elevating and lowering driving device. This die elevating and lowering driving device 46 also comprises an elevating and lowering device 50. The elevating and lowering device 50 is switched by the position switching means 31 between the position below the lower turret 2 and the retracting position away from the lower turret 2. The configuration of the elevating and lowering device 50 is slightly different from that in the die elevating and lowering driving device 16. A description will be given below of those components of the die elevating and lowering driving device 46 which are configured differently from the corresponding components of the die elevating and lowering driving device 16; components having the same configurations are denoted by the same reference numerals and will not be described below.

In the die elevating and lowering driving device 46, the elevating and lowering driving member is a servo motor 51. The rotating power of the servo motor 51 rotates a ball screw 53 via a belt transmission device 52. This moves a nut 54 threadably fitted around the ball screw 53 in a direction (Y direction) orthogonal to the direction (X direction) of the virtual straight line joining the punch position to the turret rotating center 7. Moving the nut 54 in the Y direction advances or retreats the cam member 38 in the X direction via a rack and pinion mechanism composed of a first rack 56, a pinion 57, and a second rack 58. Then, as is the case with the above embodiment, the elevating and lowering member 35 elevates or lowers via the cam mechanism composed of the cam roller 36 and cam groove 37.

The first rack 56 is slidably engaged with a guide groove 54*a* formed in the nut 54 and extending in the X direction. Thus, as the elevating and lowering device 50 moves in the X direction for position switching, the first rack 56 moves along the guide groove 54*a*. When the first rack 56 is on an extension of axis of the ball screw 53, the elevating and lowering member 35 elevates or lowers. This preferably prevents the nut 54 from being subjected to a bending moment, allowing the precise holding of the nut 54 and the ball screw 53, threadably fitted around the nut 54.

In this configuration, the elevating and lowering driving member 51 is the servo motor, which allows the easy control of elevating and lowering of the elevating and lowering member 35. This enables the die elevating and lowering driving device 46 to fix the forming die 5 at a given position such that its top surface is higher than the top surface 18*a* of the workpiece table and to lower the punch tool 4 for forming (FIG. 2), similarly to the die elevating and lowering driving device 16. The die elevating and lowering driving device 46 can further fix the punch toll 4 at a given position such that its top surface is higher than the top surface 18*a* of the workpiece table 18 and elevate the forming die 5 for forming (FIG. 3). During this forming, the die elevating and lowering driving device 46 can adjust the elevating end of the forming die 5 to set the formed part of the workpiece W at an arbitrary height. Further, since the elevating and lowering driving member 51 can be placed away from the virtual straight line, the length of the die elevating and lowering driving device 46 in the virtual straight line direction can be reduced.

While the present invention has been described with respect to preferred embodiments thereof, it will be apparent to those skilled in the art that the disclosed invention may be modified in numerous ways and may assume many embodiments other than those specifically set out and described above. Accordingly, it is intented by the appended claims to cover all modifications of the present invention that fall within the true spirit and scope of the invention.

The invention claimed is:

1. A punch press with forming dies, comprising:

a die supporting member that supports a plurality of forming dies so that the forming dies can be elevated and lowered;

a die elevating and lowering driving device that elevates and lowers the forming dies; and a die supporting member moving device that moves the die supporting member so as to locate one of the forming dies at a punch position, wherein the die elevating and lowering driving device comprises an elevating and lowering device including an elevating and lowering member that elevates and lowers the forming die located at the punch position, an elevating and lowering driving member that drivingly elevates and lowers the elevating and lowering member, and a position switching means for switching the elevating and lowering device between a position directly below the die supporting member and a retracting position that is not directly below the die supporting member, and wherein the die supporting member is a turret that moves rotatably to bring the forming die to the punch position, and the position switching means moves the elevating and lowering device in a direction of a virtual straight line joining the punch position to a rotating center of the turret, and wherein the turret has the forming dies provided on a plurality of concentric circles around the rotating center of the turret.

2. A punch press with forming dies according to claim 1, wherein the die supporting member is supported by a bolster from below and is rotatable, and an opening is formed in the bolster so that the elevating and lowering device can enter the opening.

3. A punch press with forming dies, comprising:

a die supporting member that supports a plurality of forming dies so that the forming dies can be elevated and lowered;

a die elevating and lowering driving device that elevates and lowers the forming dies; and a die supporting member moving device that moves the die supporting member so as to locate one of the forming dies at a punch position, wherein the die elevating and lowering driving device comprises an elevating and lowering device including an elevating and lowering member that elevates and lowers the forming die located at the punch position;

an elevating and lowering driving member that drivingly elevates and lowers the elevating and lowering member; and a position switching means for switching the elevating and lowering device between a position directly below the die supporting member and a retracting position that is not directly below the die supporting member, and wherein the die supporting member is supported by a bolster from below and is rotatable, and an opening is formed in the bolster so that the elevating and lowering device can enter the opening.

* * * * *